US005086595A

United States Patent [19]

Maiuccoro et al.

[11] Patent Number: 5,086,595

[45] Date of Patent: * Feb. 11, 1992

[54] STAIR SUPPORT SYSTEM

[75] Inventors: John V. Maiuccoro, Albany; John Gardenier, Guilderland, both of N.Y.

[73] Assignee: Saratoga Spa & Bath, Latham, N.Y.

[ * ] Notice: The portion of the term of this patent subsequent to Apr. 30, 2008 has been disclaimed.

[21] Appl. No.: 479,652

[22] Filed: Feb. 14, 1990

[51] Int. Cl.[5] ..... E04F 11/00

[52] U.S. Cl. ..... 52/183; 52/191

[58] Field of Search ..... 52/182, 191, 183, 184, 52/169.8; 182/93, 97, 194

[56] References Cited

U.S. PATENT DOCUMENTS

| | | | |
|---|---|---|---|
| 1,789,969 | 1/1931 | Davis . | |
| 2,532,649 | 12/1950 | Thompson | 52/182 |
| 2,636,225 | 4/1953 | Jackson | 52/191 |
| 3,099,336 | 7/1963 | Hawkins | 52/182 |
| 3,230,907 | 1/1966 | Morford et al. | 52/182 X |
| 3,381,775 | 5/1968 | Livers | 52/182 X |
| 3,556,251 | 1/1971 | Whitehead | 182/194 X |
| 3,755,981 | 9/1973 | West . | |
| 3,848,378 | 11/1974 | Witte . | |
| 3,909,997 | 10/1975 | Eickhof | 52/191 X |
| 3,994,113 | 11/1976 | Souza, Jr. . | |
| 4,015,687 | 4/1977 | Dean | 52/191 X |
| 4,106,591 | 8/1978 | Cohen et al. | 52/182 X |
| 4,589,237 | 5/1986 | Dahowski . | |
| 4,757,653 | 7/1988 | Anderholm . | |
| 4,866,894 | 9/1989 | Brown | 52/182 |

FOREIGN PATENT DOCUMENTS

| | | | |
|---|---|---|---|
| 224191 | 3/1958 | Australia | 182/93 |
| 510239 | 6/1955 | Italy . | |

OTHER PUBLICATIONS

One page from catalog printed, May 28, 1986.

*Primary Examiner*—David A. Scherbel
*Assistant Examiner*—Lan Mai
*Attorney, Agent, or Firm*—Schmeiser, Morelle & Watts

[57] ABSTRACT

A stair support system for supporting a plurality of steps using an outer leg and stringer assembly. The stringer includes a plurality of risers which extend upwardly from the stringer to support the individual steps. Attached to and underlying each step is a channel member which extends along the length of the step and is sandwiched between the riser and the step's undersurface. Also disclosed is a deck support structure that is attachable to the outer leg to which the stringer is attached.

15 Claims, 4 Drawing Sheets

STAIR SUPPORT SYSTEM

FIELD OF THE INVENTION

The instant invention is in the field of support structures. More particularly, the invention is a truss-type support structure adapted to underlie and support a prefabricated series of connected steps. Ideally, the invention would be used to support a pre-made stair set which is a part of a pool-type structure. The support system can also include structure which will support a portion of a deck adjacent to the top step.

BACKGROUND OF THE INVENTION

Large prefabricated structures such as pools, Jacuzzi's (tm), hot tubs and walk-in tanks will often have the steps formed as an integral part of the wall structure or as a prefabricated bolt-in assembly. Commonly, the mold for the pool or tank will include a portion that forms the steps. In this way, the steps are formed with the rest of the wall surface and additional sealing between the steps and wall is avoided. In an alternate fabrication method, the pool or tank is made with an incomplete wall. A set of stairs which forms the missing wall section is separately fabricated and later bolted into place with a sealing material placed in the connection joint to prevent leakage. In these types of applications, the steps normally require some form of exterior support when the pool or tank is installed. As can be seen in the prior art, each step is normally individually supported by a vertical member which extends from the step downwardly to some form of base structure such as a concrete foundation. This may be seen in the patent to Dahowski U.S. Pat. No. 4,589,237 which is directed to a stair support system for swimming pool steps.

The above described methods of prefabricating stairs greatly enhanced the simplicity and ease of installation of the pools or tanks in which they were used. A separate set of stairs which fit over the pool or tank wall was not required and, as noted above, the molded in stairs reduced leakage problems. However, the molded or prefabricated stairs did create certain problems associated with the installation since the steps require a high degree of support to prevent bending or flexing of the attached wall. It is the object of the instant invention to provide a system which facilitates the installation of pools or tanks that use prefabricated steps. Until this time, the supporting of the prefabricated steps has been a time consuming, laborious and therefore expensive process. Supporting of the steps also required manual labor in the physically restrictive area beneath the steps.

An additional problem associated with pool or tank structures having prefabricated steps arises in the landing or deck proximate the top step. In the past, the surface leading to the top step required its own support structure. This often entailed additional excavation for a broadened foundation and the use of additional support members. Once in place, there were subsequent problems due to rubbing contact between the end of the top step and the deck/surface adjacent the step. The source of the latter problems clearly arising from the necessity of using separate supports for the steps and their adjacent structure.

SUMMARY OF THE INVENTION

The instant invention is a system for supporting a prefabricated series of connected steps that makes use of a truss-type assemblage of members. The system includes a pair of pivotally mounted, adjustable length outer support legs. Pivotally and removably connected to the outer legs are a pair of stair support members (stringers). Each stringer is anchored/fastened at its bottom end to the prefabricated structure below the steps. The stringers include a series of upwardly extending vertical risers which contact channel supports that are located beneath each individual step. In this way, a plurality of steps can be supported as a unit.

The instant invention is designed to be easily fastened to or disengaged from the pool or tank unit in order to facilitate transport of the unit and installation of the support structure. Once the unit is transported to its installation site, the upper portion of each outer leg is swung into its vertical position and the bottom portion of each leg is then attached. Next, the bottom end of the stringers are attached to the pool or tank below the stairs and the stringers are then positioned so that they underlie the entire length of the steps. The top of the stringers are then attached at a suitable location to the outer legs.

The stair support system, as will be described in greater detail later, minimizes the materials, labor and ultimate cost of supporting a series of prefabricated steps. It is composed of basic, readily available materials such as steel channels, angle irons, etc.. These materials are long lasting, relatively light-weight and extremely durable. Once in place, the stair support structure fully supports the prefabricated series of steps including the added weight of the liquid when the pool or tank is filled. In addition, the size of the foundation required for supporting the outer leg is significantly less than was required for the prior art staggered leg support systems.

The basic stair support of the instant invention can be modified with an additional triangular truss mounted to the outer leg for supporting a platform adjacent to the stairs. For a pool, this would be a portion of the decking proximate the top of the stairs. For a tank, this platform would be atop the ladder that extends along the exterior side of the tank from the ground to the top of the tank. By thus linking the stair support structure with the deck or platform support, all relative motion between the two adjacent elements is virtually eliminated. In addition, the necessity for a separate deck foundation in the vicinity of the steps is negated. This leads to a reduction in the installation time and cost for the adjacent deck or platform.

DETAILED DESCRIPTION OF THE INVENTION

Figure 1:
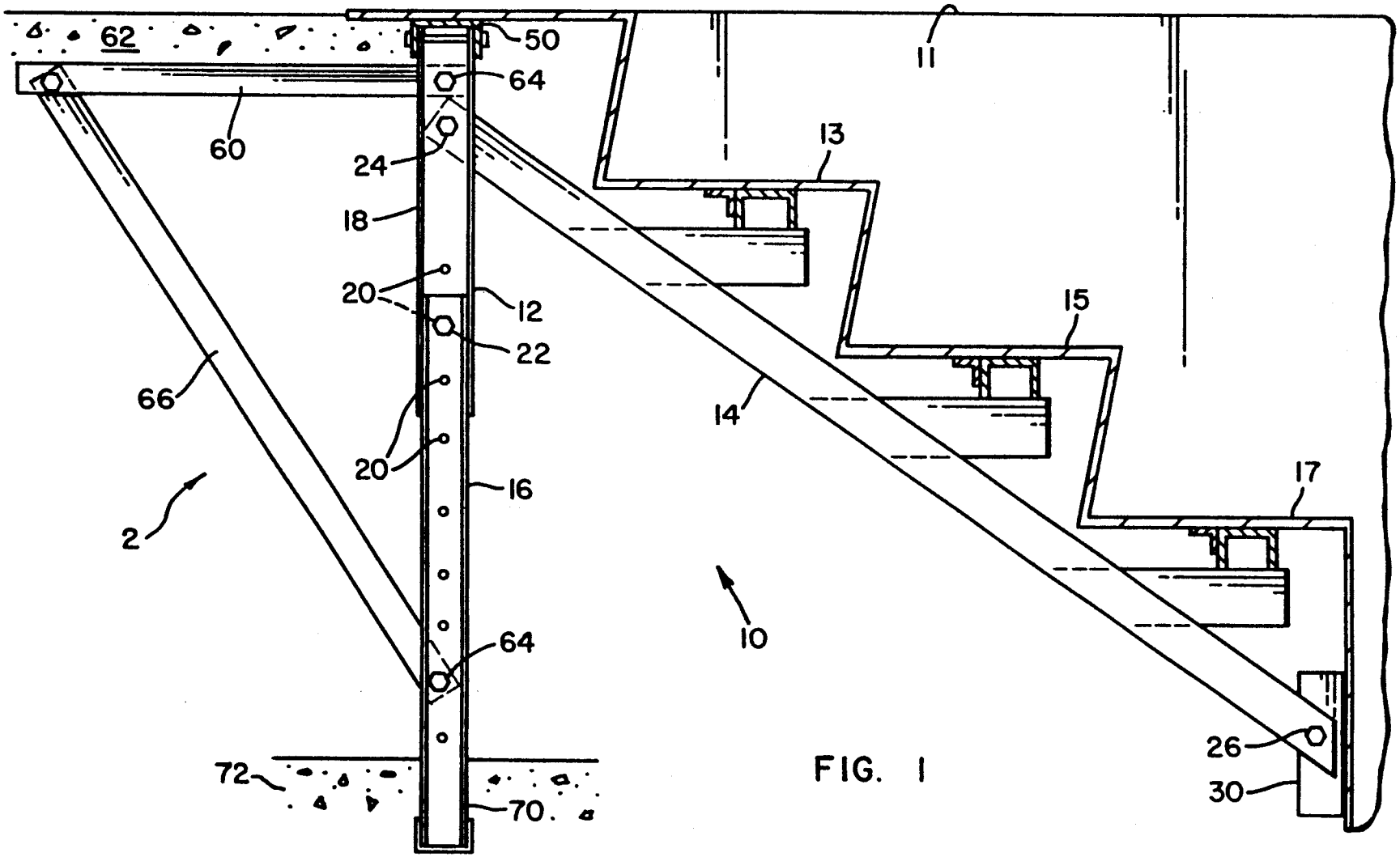
FIG. 1 is an elevation view of a portion of a pool-like structure showing the instant invention in place supporting the stairs and deck.

The instant invention is a stair support system and is shown in FIG. 1 and labeled as 10. The system is shown attached to a pool 11 that has a series or flight of connected steps 13, 15, and 17. The stairs are in unitary form—i.e. they are fashioned as a single piece. The system is comprised of a pair of outer legs 12 and a pair of stringers 14. Each outer leg has a removable lower portion 16 which is attachable to the upper portion 18 by nut and bolt fastening means 22. The point of attachment between the upper and lower portions of the outer legs is adjustable and can be changed by inserting the bolt through a different one of holes 20.

Pivotally and removably attached to each outer leg proximate its top is a stringer 14. The stringer is fastened at one end to the outer leg 12 by at least one fastener 24. The other end of the stringer is attached by a fastener 26 to the prefabricated structure below the bottom step 17. FIG. 1 shows a strengthening member 30 attached to the pool at the lower stringer mount location in order to distribute the stresses imposed. It should be noted that when only a single end of the stringer is attached, the stringer can be pivoted about the attachment point.

Figure 2:
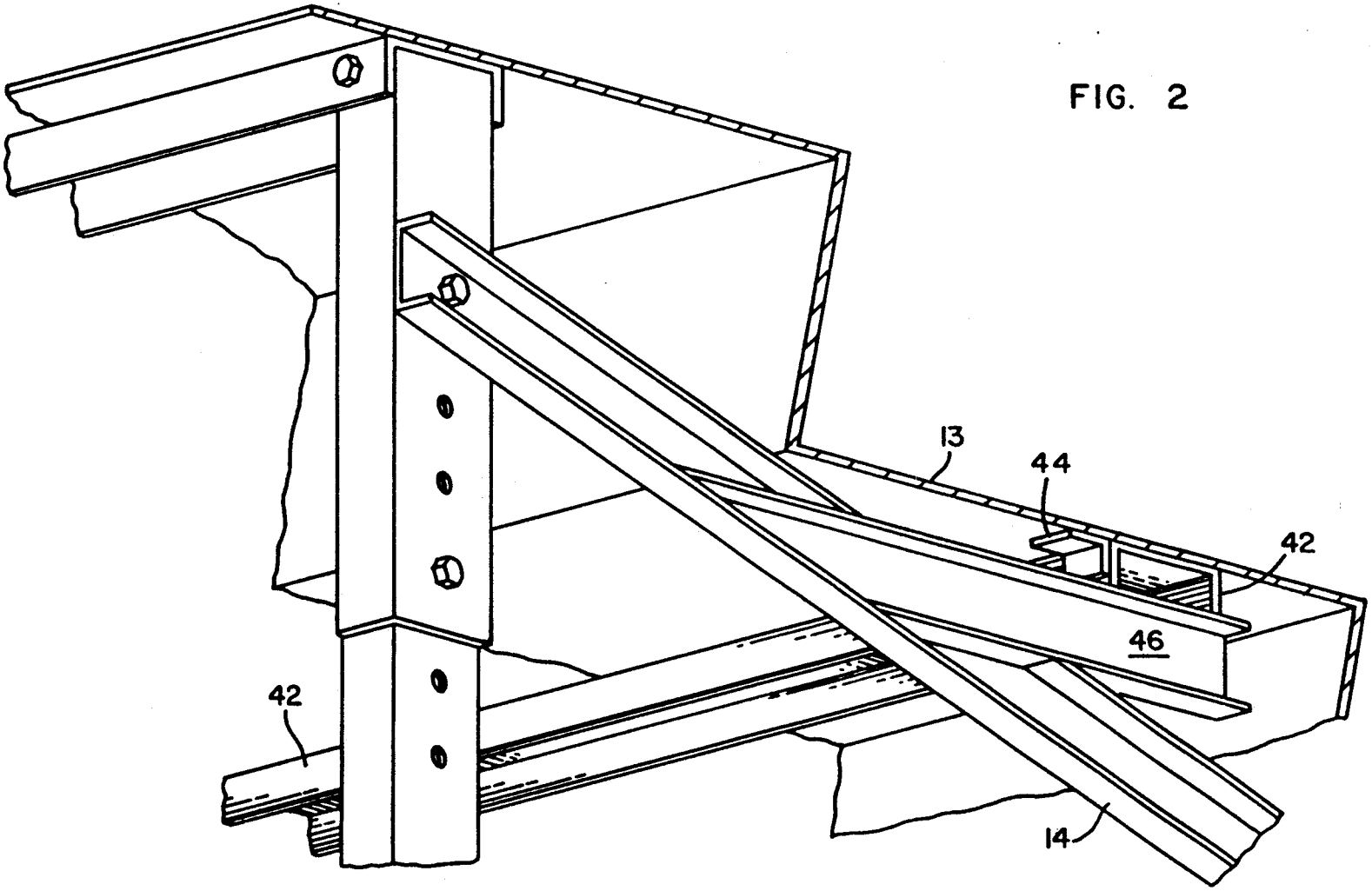
FIG. 2 is a detailed perspective view of the support system in the area of the top step.

FIG. 2 shows a detail of a top stair being supported by the instant invention. To the underside of stair 13 is affixed a horizontally oriented, elongated channel member 42. The channel member underlies substantially the entire length the step and at least a portion of its width. The purpose of the channel member is to transfer weight from the otherwise flexible step to the support system. The attachment between the stair and channel member is accomplished by use of angle members 44 located preferably at least at each end of the stair. The angle members have one side permanently affixed to the stair 13 and the other side removably affixed to channel member 42.

Attached to the stringer 14 are a plurality of risers 46. There is at least one riser below each step. Each riser extends upwardly at an angle relative to the longitudinal axis of the stringer to contact an end of an associated channel member 42. The risers function to transfer weight from the channel 42 to the stringers 14. One embodiment of riser is shown in the figures. It is pointed out that the risers can also be in the form of vertical members that extend upwardly from the stringer directly to each channel member. The risers are mounted to the stringers using conventional mounting methods such as welding or fasteners.

Figure 3:
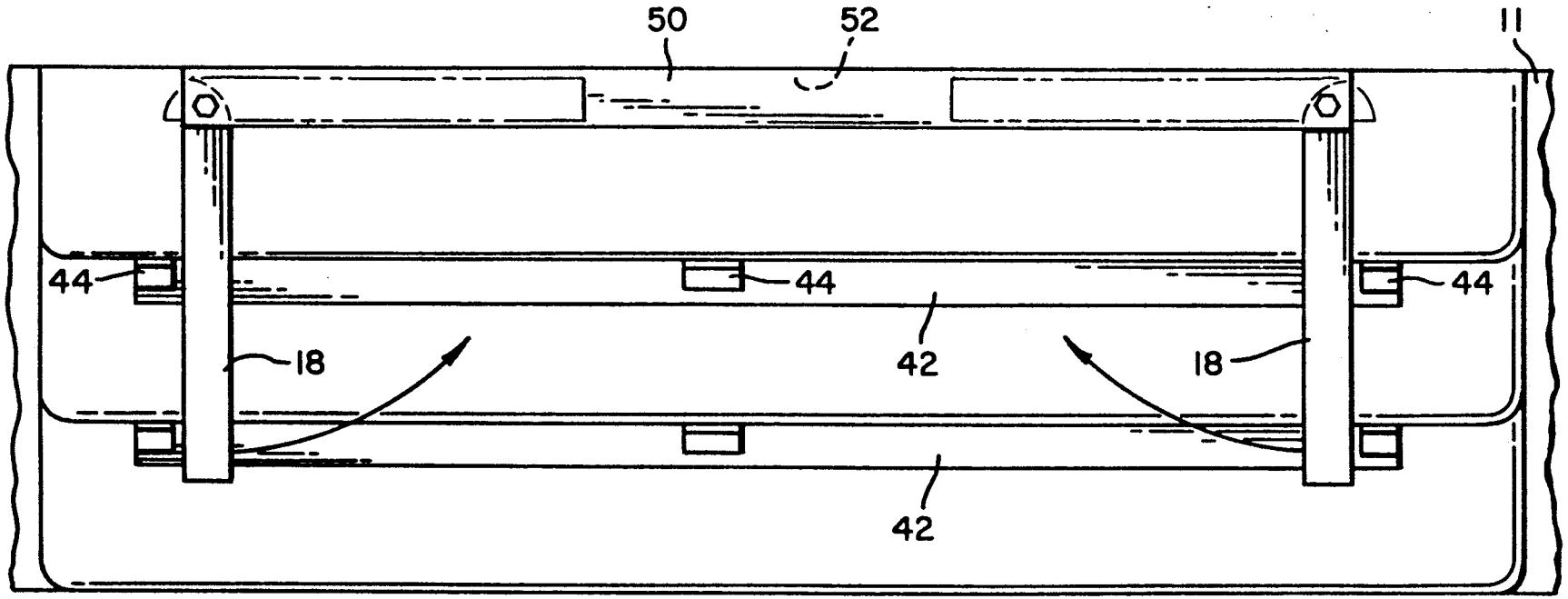
FIG. 3 is an end view of the initial installation of a portion of the support system.

In FIG. 3, the pool structure is shown in the partially assembled condition in which it would be placed prior to shipment from the factory or storage facility. The upper portions of the outer legs are pivotally attached to the pool so that they may be positioned in either a vertical or horizontal orientation. The horizontal position is shown in phantom in FIG. 3. As can be seen in the figure, the top portion 50 of the legs are arcuately shaped so that the legs can be swung inwardly to a horizontal position. When swung downwardly from their horizontal position, the top portion 50 of each leg abutts the bottom surface 52 of the receiving channel when the leg reaches its vertical position. This creates a snug, secure fit between the top of the outer leg and the receiving channel. Swinging the legs to the above described horizontal position facilitates moving of the pool with the upper leg portions attached by eliminating protruding members from the formed structure.

As can be seen in FIG. 3, the channel members 42 are also attached to the pool assembly prior to moving the pool to the installation site. As shown, there are three angle members 44 attaching each channel member to its associated step.

FIG. 1 shows the final in-situ installation. Once at the site, the upper portion 18 of each outer leg is secured in its vertical position. Next, the stringers are attached as earlier described (at their bottom end first and finally, their top ends are attached to the outer legs). Alternatively, each stringer 14 can be first attached to the outer leg by at least one nut and bolt. This allows the stringer to be pivoted about its attachment point so that it can be properly positioned beneath the steps. Once in its proper position, the stringer underlies the steps with its risers 46 in contact with the channel members 42. Then, the bottom end of the stringer is attached to the mount 30 by at least one fastener.

After the stringers have been properly positioned and attached, the bottom portion 16 of each outer leg is connected to the outer leg top portion 18. Both the leg bottom and top portions have a plurality of holes 20 with which they can be joined by fasteners. The large number of holes enables the final leg length to be adjusted to meet foundation conditions—i.e. so that the leg is of sufficient length to allow the leg's bottom end 70 to be adequately covered with concrete 72.

In addition, the outer leg adjustability allows a modicum of adjustability relative to the stringer placement adjacent the steps. If there is a slight gap between the risers and channel members, the outer leg can be slightly lengthened thereby pushing the leg's retaining flange 50 slightly upwardly and thereby slightly raising the stringers and their associated risers. As an alternative, shims (not shown) can be placed between the risers and channel members to ensure contact.

It should be noted that proper fabrication of the stringers minimizes the adjustments that may be required at the installation site. The fabrication is normally accomplished at the factory or storage assembly where the stringer is checked against the pool/stair structure in which it will be placed. This is done prior to drilling of its last mounting hole. In more detail, the stringer is completely made up except for the hole for fastener 26. The upper end of the stringer is mounted to the outer leg by fastener 24. Then, the stringer is properly positioned so that the risers slightly push up on the channel members 42. Finally, the bottom end of the stringer is positioned within or adjacent structural mount 30. The correct hole position for fastener 26 is then marked on the stringer and the stringer removed and the hole drilled. Later, when the pool is located at the installation site, the stringer can be installed with little or no adjustment required.

There are other methods which can be used for installing/adjusting the stringer(s). The stringers can be welded in place in-situ in lieu of using fasteners. The points at which the stringer is mounted can include a plurality of holes (similar to the telescoping adjustability of the outer leg) and the proper holes can be used once the stringer is in place. The mounting locations can also make use of slots in lieu of holes to allow some inherent adjustability.

Another method of system adjustability can be included in the riser fabrication. The risers can be attached to the stringer(s) by fasteners and their mounting can include slots in which the fasteners can slide until they are tightened thereby allowing some vertical adjustability of the risers. The risers may incorporate other well known methods of vertical adjustability in which the length of the riser is variable.

FIG. 1 also shows an optional frame 2 which can be added to the basic support structure of the instant invention. The frame is comprised of an upper support platform 60 onto which concrete 62 or other deck materials can be placed. The support platform is attached to the outer leg 12 by fasteners 64. A pair of diagonal members 66 are attached to the outer end of the platform 60 and act to transfer the load to leg 12.

Throughout this discussion, a support structure having a pair of outer legs 12 has been described. The legs are positioned in line with the outer ends of the series of stairs. In some instances, such as when narrow stairs are to be used, the support structure may comprise only a single outer leg with a single stringer. The leg and stringer would be placed in line with the center of the stairs and would therefore be used to support the stairs at their midpoints.

Figure 4:
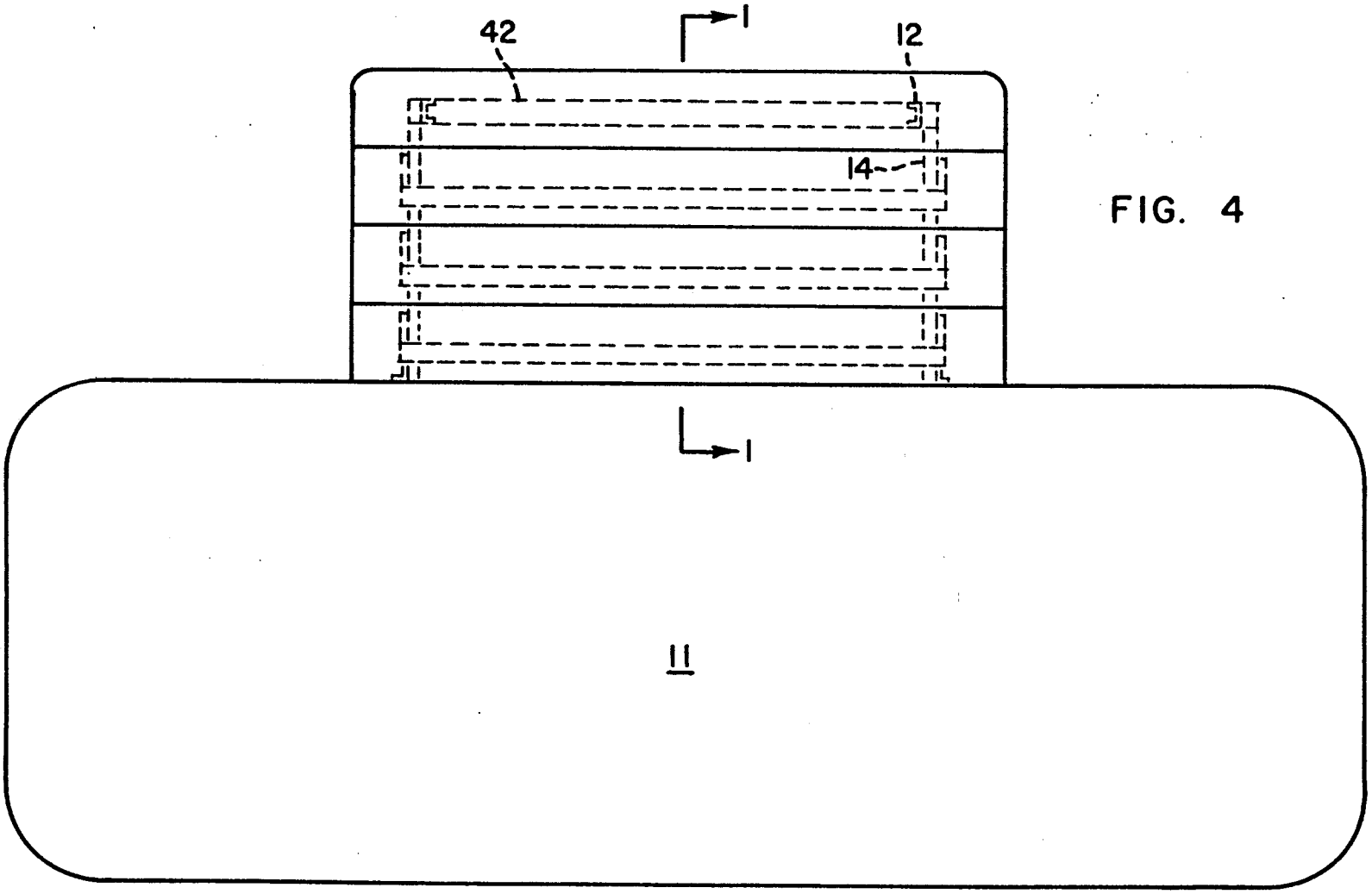
FIG. 4 is a plan view of the pool-like structure shown in FIG. 1.

FIG. 4 is a plan view of the pool structure shown in FIG. 1. In this figure, the support structure is shown without the optional deck support attached. The relative orientation of the channel members 42, stringers 14 and outer legs 12 can be easily seen.

The embodiments disclosed herein have been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A stair support system for use with and supporting a prefabricated stair module comprising a molded plurality of staggered stair treads and risers, said system comprising:

an outer leg having a bottom end and a top end, said bottom end including securing means for securing it to a foundation means and said top end including fastening means for attaching said top end to an underside of a stair tread support means which traverses essentially the underside of a tread;

a singular stringer having a top end removably connected to said outer leg proximate and under said top end, said stringer underlying at least two of said steps and having fastening means at a bottom end for attachment to the module at the rear, lower portion of its lowest stair riser; and a plurality of straight stair support members, each member having one end connected to said stringer and a free end underlying and supporting a separate stair tread support means which underlies each of said steps in slidably detached fashion.

2. The stair support system of claim 1 wherein said stringer connection to said outer leg is pivotally mounted to allow said leg to fold inward of the module in a plane orthogonal to a stringer-leg plane.

3. The stair support system of claim 1 wherein said outer leg is longitudinally adjustable.

4. The stair support system of claim 1 further comprising a tread support means underlying and removably attached to at least one of said steps and located above and in slidable contact with at least one of said stair support members.

5. The stair support system of claim 1 further comprising a second outer leg and associated stringer and support members, wherein said second leg, stringer and support members are located and fixed independently of, and spaced from, the other outer leg, stringer and support members, wherein said outer leg and said second outer leg top ends are coupled through a single tread support means.

6. A stair support system for supporting a prefabricated modular flight of stair comprising a plurality of staggered steps, each step defined by a riser and a tread, said system comprising:

a pair of spaced outer legs, each of said legs having a bottom end adapted to be secured to a foundation means and a top end including pivotal fastening means for attaching to a rigid tread support member that is disposed under the steps of said module;

a pair of stringers, wherein each of said stringers is connected to a different one of said pair of outer legs below the tops thereof and underlies at least two treads of said steps associated with said prefabricated modular flight of stairs, wherein each of said stringers is attached to one end to one of said outer legs and attached at a second end to a structure associated with a rear side of the lowest stair riser of said prefabricated stairs; and a plurality of step support members attached to said stringers so that each of said support members underlies and supports a free, rigid tread support of one step of said prefabricated flight of stairs.

7. The stair support system of claim 6 wherein said connection between said stringers and said outer legs includes pivoting means whereby during an initial setup of the support system, each of the stringers can be pivoted relative to the outer legs into a position for supporting said steps.

8. The stair support system of claim 6 wherein said outer legs are longitudinally adjustable.

9. The stair support system of claim 6 further comprising a tread support member underlying and removably attachable to at least one of said steps and located above and in slidable contact with at least one of said step support members.

10. The stair support system of claim 6 including means for adjusting the location of said step support members.

11. The stair support system of claim 10 wherein the attachment point of the stringers to the outer legs is adjustable in an axis parallel to a longitudinal axis of the outer legs.

12. A stair support system for underlying and supporting a prefabricated series of connected steps, said system comprising:

at least one adjustable length leg, said leg having a top end which is capable of being operatively connected to and pivotally mounted with respect to a rigid tread support member running under an upper portion of said series of steps said leg having a bottom end pivotally moveable into the rigid tread support member and also capable of being secured at said bottom end to a foundation means;

at least one stringer means having one end operatively connected to the support leg and having connection means at another end for operative connection to a step riser at a bottom step of said series of steps; and a plurality of stringer risers wherein each said riser has one end only attached to said one stringer means and another end in support contact with a step tread support of a step member which underlies one of said steps; and a deck support means operatively connected to the support leg for supporting a deck and located proximate the upper portion of said series of steps.

13. The system of claim 12 also comprising at least one rigid member in contact with an underside of at least one stair, said member operatively connecting at least one of said stringer risers to said stair as said member extends in a direction perpendicular to a longitudinal axis of said stringer and at least one support leg in extended position.

14. The system of claim 12 wherein said connections at each end of said one stringer means are manually separaole so that said stringer means is capable of being disconnected from said outer leg and from said step riser at the bottom step of said series of steps.

15. The stringer risers of claim 12 wherein each said riser is a rigid, straight, singular and operationally vertically oriented member which is essentially parallel to a fully extended outer leg.

* * * * *